US008128186B2

(12) United States Patent
Bauman

(10) Patent No.: US 8,128,186 B2
(45) Date of Patent: Mar. 6, 2012

(54) NON-VOLATILE MEMORY DATA INTEGRITY VALIDATION

(75) Inventor: Joseph H. Bauman, Vancouver, WA (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 900 days.

(21) Appl. No.: 11/881,543

(22) Filed: Jul. 27, 2007

(65) Prior Publication Data

US 2009/0027439 A1 Jan. 29, 2009

(51) Int. Cl.
*B41J 29/393* (2006.01)
*B41J 29/38* (2006.01)

(52) U.S. Cl. ..... 347/19; 347/5

(58) Field of Classification Search ..... 347/19
See application file for complete search history.

(56) References Cited

U.S. PATENT DOCUMENTS

| | | | |
|---|---|---|---|
| 4,551,000 | A | 11/1985 | Kanemitsu et al. |
| 4,803,521 | A | 2/1989 | Honda |
| 4,961,088 | A | 10/1990 | Gilliland et al. |
| 5,021,828 | A | 6/1991 | Yamaguchi et al. |
| 5,137,379 | A | 8/1992 | Ukai et al. |
| 5,138,344 | A | 8/1992 | Ujita |
| 5,184,181 | A | 2/1993 | Kurando et al. |
| 5,272,503 | A | 12/1993 | LeSueur et al. |
| 5,363,134 | A | 11/1994 | Barbehenn et al. |
| 5,410,641 | A | 4/1995 | Wakabayashi et al. |
| 5,506,611 | A | 4/1996 | Ujita et al. |
| 5,519,422 | A | 5/1996 | Thoman et al. |
| 5,610,635 | A | 3/1997 | Murray et al. |
| 5,646,660 | A | 7/1997 | Murray |
| 5,699,091 | A | 12/1997 | Bullock et al. |
| 6,148,368 | A | 11/2000 | DeKoning |
| 6,264,301 | B1 | 7/2001 | Helterline et al. |
| 6,267,463 | B1 * | 7/2001 | Paulsen et al. ..... 347/19 |
| 6,725,392 | B1 | 4/2004 | Frey et al. |

(Continued)

FOREIGN PATENT DOCUMENTS

EP 0 854 043 B1 4/2001

(Continued)

OTHER PUBLICATIONS

International Search Report dated Feb. 5, 2009 for international application No. PCT/US2008/070890 filing date Jul. 23, 2008.

*Primary Examiner* — Uyen Chau N Le
*Assistant Examiner* — Kajli Prince

(57) ABSTRACT

The present disclosure relates to a replaceable printing component for use in a printing system including print mechanism configured to receive the replaceable printing component. The replaceable printing component includes an electrical storage device responsive to printing system control signals for selectively storing information received from the print mechanism, the electrical storage device includes a storage portion containing data associated with the replaceable printing component, and first and second validation fields configured to store error detection codes relatable to the data contained in the storage portion to determine whether the data is valid. Wherein the electrical storage device is configured, prior to a first transfer of data from the print mechanism to the storage portion, to receive and store in one of the first and second validation fields an error detection code related to the data currently contained in the storage portion, and the electrical storage device is configured to receive and store in the other of the first and second validation fields an error detection code related to the data that will be contained in the storage portion after the first data transfer.

7 Claims, 4 Drawing Sheets

U.S. PATENT DOCUMENTS

| | | | |
|---|---|---|---|
| 2003/0189607 | A1 | 10/2003 | Bullock |

FOREIGN PATENT DOCUMENTS

| | | | |
|---|---|---|---|
| EP | 0 854 044 | B1 | 4/2001 |
| EP | 0 878 307 | B1 | 3/2002 |
| EP | 0 812 693 | B1 | 3/2006 |
| FR | 2 744 391 | | 8/1997 |
| JP | 8-310007 | | 11/1996 |
| JP | 2007007946 | A | 1/2007 |
| WO | WO 98/04414 | | 2/1998 |

* cited by examiner

NON-VOLATILE MEMORY DATA INTEGRITY VALIDATION

BACKGROUND

The present disclosure relates to printing systems that make use of a replaceable printing component. More particularly, the present disclosure relates to replaceable printing components that include an electrical storage device for providing information to a print mechanism in the printing system.

Printers frequently make use of replaceable components in order to extend the life of the printer. For instance, ink-jet printers frequently make use of an ink-jet printhead mounted within a carriage that is moved back and forth across a print media, such as paper. As the printhead is moved across the print media, a control system activates the printhead to deposit or eject ink droplets onto the print media to form images and text. Ink is provided to the printhead by a supply of ink which is either carried by the carriage or mounted elsewhere on the print mechanism. Some printing components, such as ink containers and printheads, require periodic replacement. Ink containers are replaced when exhausted. Printheads are replaced at the end of printhead life.

As discussed in U.S. Pat. No. 5,699,091, entitled "Replaceable Part With Integral Memory For Usage, Calibration And Other Data," assigned to the assignee of the present disclosure, it may be desirable to alter printer parameters concurrently with the replacement of printer components U.S. Pat. No. 5,699,091 discloses the use of a memory device, which contains parameters relating to the replaceable part. The installation of the replaceable part allows the printer to access the replaceable part parameters to ensure high print quality. By incorporating the memory device into the replaceable part and storing replaceable part parameters in the memory device within the replaceable component, the printing system can determine these parameters upon installation into the print mechanism. This automatic updating of printer parameters frees the user from having to update printer parameters each time a replaceable component is newly installed. Automatically updating printer parameters with replaceable component parameters ensures high print quality. In addition, this automatic parameter updating tends to ensure the printer is not inadvertently damaged due to improper operation, such as, operating after the supply of ink is exhausted or operation with the wrong or non-compatible printer components.

U.S. Pat. Nos. 6,267,463 and 6,264,301, assigned to the assignee of the present disclosure, disclose a system and method of reliably updating memory on replaceable printing components, and a method and apparatus for identifying parameters in a replaceable printing component. The complete disclosures of the above-identified patents are hereby incorporated by reference for all purposes.

The exchange of information between the printer and the replaceable printing component should be accomplished in a highly reliable manner. This exchange of information should not require the intervention of the user. Furthermore, it is important that the integrity of the information should be preserved. In the event that the information associated with the replaceable component is corrupted in some manner, the printer should be capable of identifying this data as corrupted. Furthermore, in the event of such corruption, the printing system should be configured to reject the component, so that the printer is not damaged. Finally, the printing system should have sufficient flexibility to accommodate improvements, as well as additional printer parameters necessary to support these improvements.

DETAILED DESCRIPTION

Figure 1:
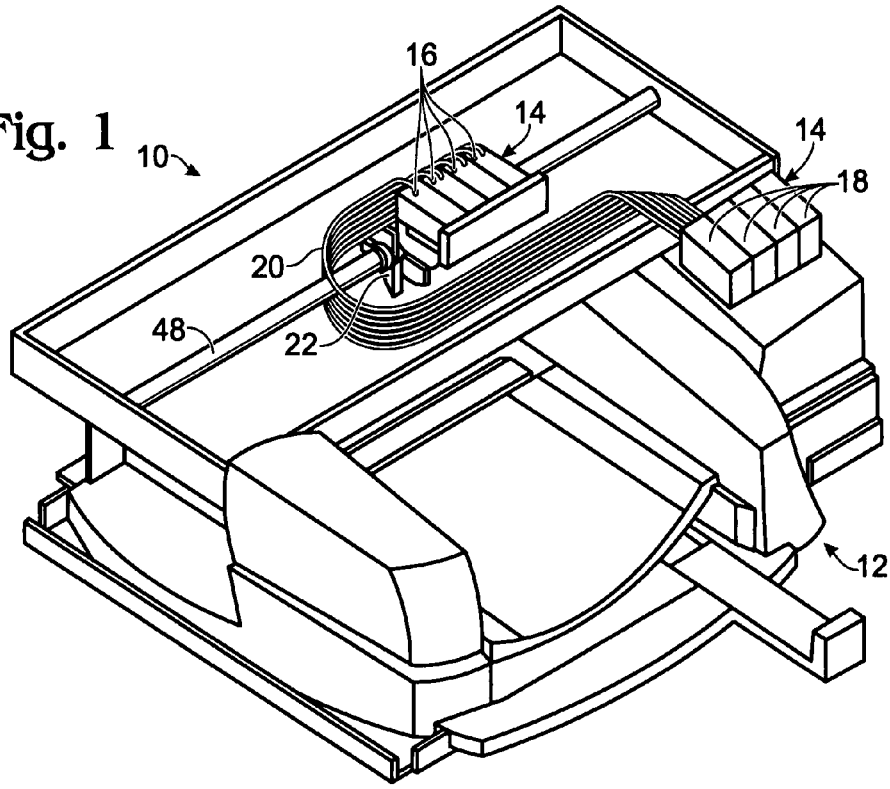
FIG. 1 depicts a perspective view of an example printing system, shown with the cover removed, that incorporates removable printing components in accordance with the present disclosure.

FIG. 1 is a perspective view of an illustrative printing system 10, shown with its cover removed. In this example, printing system 10 is an ink-jet printing system. Other types of printing systems, such as laser or thermal, also may include replaceable components and/or utilize disclosed methods.

In this example, ink-jet printing system 10 includes a print mechanism 12 having a plurality of replaceable printing components 14 installed therein. The printing components include printheads 16 for selectively depositing ink in response to control signals, and ink containers 18 for providing ink to each of the printheads. As indicated, each printhead may be fluidically connected to a corresponding ink containers 18 by a flexible conduit 20.

Printheads 16 are mounted in a scanning carriage 22, which is scanned past print media as the print media is stepped through a print zone. As the printheads are moved relative to the print media, ink is selectively ejected from orifices in the printheads 16 to form images and text.

One aspect of the present disclosure relates to a method and device configured for storing information on replaceable printing components 14 for updating operation parameters of print mechanism 12. An electrical storage device 38 (seen in FIGS. 2A and 2B) may be associated with each of the replaceable printing components 14. Electrical storage device 38 contains information related to the particular replaceable printer components 14. Installation of a replaceable printing component 14 into print mechanism 12 allows information to be transferred between electrical storage device 38 and print mechanism 12, ensuring high print quality and avoiding the installation of non-compatible replaceable printing components 14. The information provided from replaceable printing components 14 to printing portion 12 also may prevent operation of printing system 10 in a manner which damages any component of the printing system, or which may reduce the print quality.

Although printing system 10 (shown in FIG. 1) makes use of ink containers 18 which are mounted off of scanning carriage 22, the disclosed component and method are well suited for other types of printing system configurations. In one such configuration, replaceable ink containers 18 are mounted on scanning carriage 22. Printhead 16 and ink container 18 also may be incorporated into an integrated printing cartridge that is mounted to scanning carriage 22. Finally, printing system 10 may be used in a wide variety of applications such as facsimile machines, postal franking machines, copiers and large format type printing systems suitable for use in displays and outdoor signage.

Figure 2B:
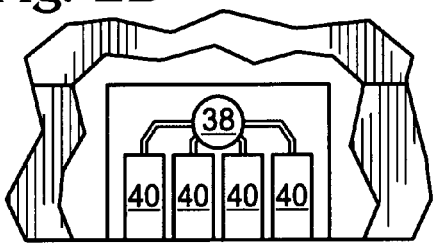
FIGS. 2A and 2B together depict a schematic representation of the printing system shown in FIG. 1, illustrating a removable ink container and printhead, each containing an electrical storage device in accordance with the present disclosure.
Figure 2A:
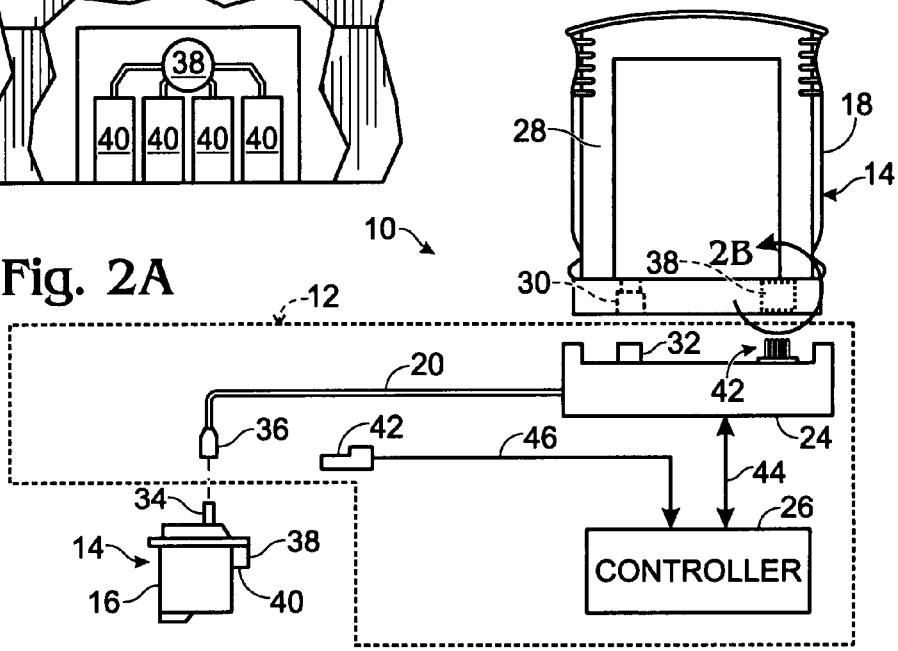

FIGS. 2A and 2B depict a simplified schematic representation of the printing system shown in FIG. 1. FIGS. 2A and 2B are simplified to illustrate a single printhead 16 and a single ink container 18 for accomplishing the printing of a single color. Where more than one color is desired, a plurality of printheads 16 may be used, each having an associated ink container 18 as shown in FIG. 1.

Print mechanism 12 may include an ink container receiving station 24 and a controller 26. With ink container 18 properly inserted into ink container receiving station 24, an electrical and a fluidic coupling is established between the ink container and the print mechanism. The fluidic coupling allows ink stored within ink container 18 to be provided to printhead 16. The electrical coupling allows information to be passed between ink container 18 and print mechanism 12 to ensure the operation of print mechanism 12 is compatible with the ink contained in ink container 18, thereby achieving high print quality and reliable operation of the printing system.

Controller 26 may control the transfer of information between print mechanism 12 and replaceable printing components 14. For instance, controller 26 may control the transfer of information between printhead 16, ink container 18, and controller 26. The controller also may control the relative movement of printhead 16 and the print media, as well as selectively activating the printhead to deposit ink on print media.

Ink container 18 includes a reservoir 28 for storing ink therein. A fluid outlet 30 is provided that it is in fluid communication with fluid reservoir 28. Fluid outlet 30 may be configured for connection to a complimentary fluid inlet 32 associated with ink container receiving station 24.

Printhead 16 includes a fluid inlet 34 configured for connection to a complimentary fluid outlet 36 associated with print mechanism 12. With the printhead properly inserted into scanning carriage 22 (shown in FIG. 1), fluid communication may be established between the printhead and ink container 18 by way of flexible fluid conduit 20.

Each replaceable printing component (such as the printhead 16 and the ink container 18) may include an electrical storage device 38. These electrical storage devices 38 may also be referred to as information storage devices or memory, and may be used for storing information related to the respective replaceable printer components. A plurality of electrical contacts 40 may be provided on each replaceable printing component 14, each contact being electrically connected to electrical storage device 38.

With ink container 18 properly inserted into the ink container receiving station 24, each electrical contact 40 may engage a corresponding electrical contact 42 associated with ink container receiving station 24. Electrical contact 42, in turn, may be electrically connected to controller 26 by one or more electrical conductor 44. With proper insertion of ink container 18 into ink container receiving station 24, electrical storage device 38 (associated with ink container 18) may be electrically connected to the controller 26, allowing information to be transferred between ink container 18 and print mechanism 12.

Likewise, a plurality of electrical contacts 40 on printhead 16 may be electrically connected to electrical storage device 38. With printhead 16 properly installed into print mechanism 12, electrical contacts 40 may engage a corresponding electrical contacts 42 (associated with the printer body 12). Once engaged, the electrical storage device 38 may be electrically connected to the controller 26 by way of one or more electrical conductors 46.

Although electrical storage devices 38 associated with each ink container 18 and printhead 16 are given the same identifier to indicate similar function, the information stored in the electrical storage device (38) associated with the ink container 18 will be different from the information stored in the electrical storage device (38) associated with the printhead 16. Similarly, the information stored in electrical storage device 38 associated with each ink container of the plurality of ink containers 18 will, in general, be unique to that particular ink container. The particular information stored on each electrical storage device 38 will be discussed in more detail below.

Figure 3:
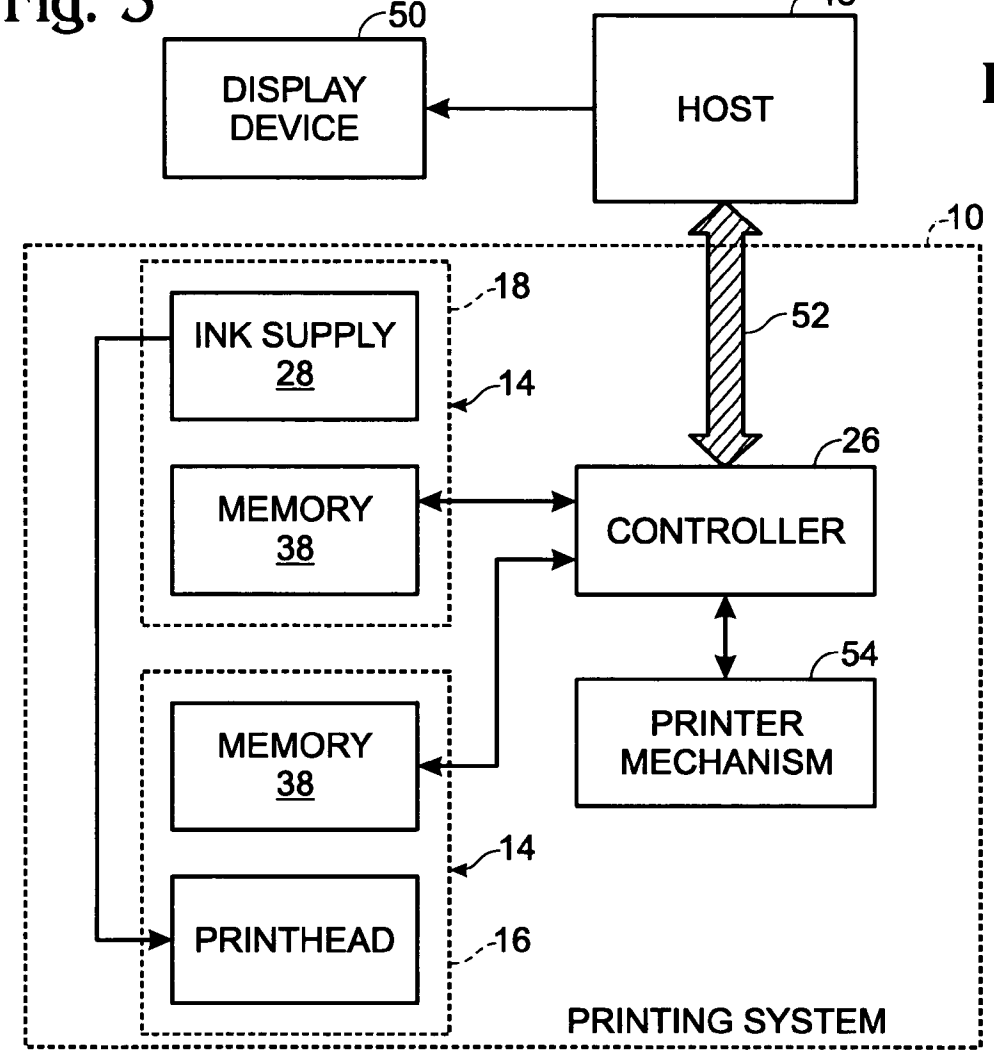
FIG. 3 depicts a schematic block diagram of the printing system of FIG. 1 shown connected to a host.

FIG. 3 represents a block diagram of an example printing system 10 shown connected to an information source or host computer 48. Host 48 is shown connected to a display device 50. The host can be any of a variety of information sources (such as a personal computer, work station, or server, to name a few) that provides image information to controller 26 by way of a data link 52. Data link 52 may be any of a variety of conventional data links (such as an electrical link, infrared link, a wide-area or local-area network link, or any other well-known data link) for transferring information between host 48 and printing system 10.

In addition to being electrically linked to electrical storage devices 38 associated with replaceable printing components 14, controller 26 may be electrically linked to a printer mechanism 54 for controlling media transport and movement of carriage 22. This link may be a variety of different linkages such as electrical or optical linkage that supports information transfer. Controller 26 may make use of parameters and information provided by host 48 and memory 38 to accomplish printing.

Host 48 may provide image description information or image data to printing system 10 for forming images on print media. In addition, host 48 may provide various parameters for controlling operation of the printing system, typically through printer control software referred to as a "print driver". In order to ensure that the printing system provides the highest quality images, controller 26 may compensate for the particular replaceable printer component 14 installed within the printing system. Electric storage device 38 may provide parameters particular to the associated replaceable printer component 14 to controller 26, allowing the controller to utilize these parameters to ensure the reliable operation of the printing system and ensure high quality print images.

Parameters that may be associated with a replaceable printing component 14 and stored in electrical storage device 38 may include the following: amount of ink shipped in an ink container; remaining ink in an ink container; actual count of ink drops emitted from the printhead; a date code associated with the ink container; date code of initial insertion of the ink container; system coefficients; ink type/color: ink container size; age of the ink; printer model number or identification number; cartridge usage information; just to name a few. In printing systems including other types of print mechanisms, such as laser printing systems, these parameters may be associated with other types of replaceable printing components. Accordingly, in such systems, the parameters may include information related to toner cartridges or other appropriate replaceable printing components.

Figure 4:
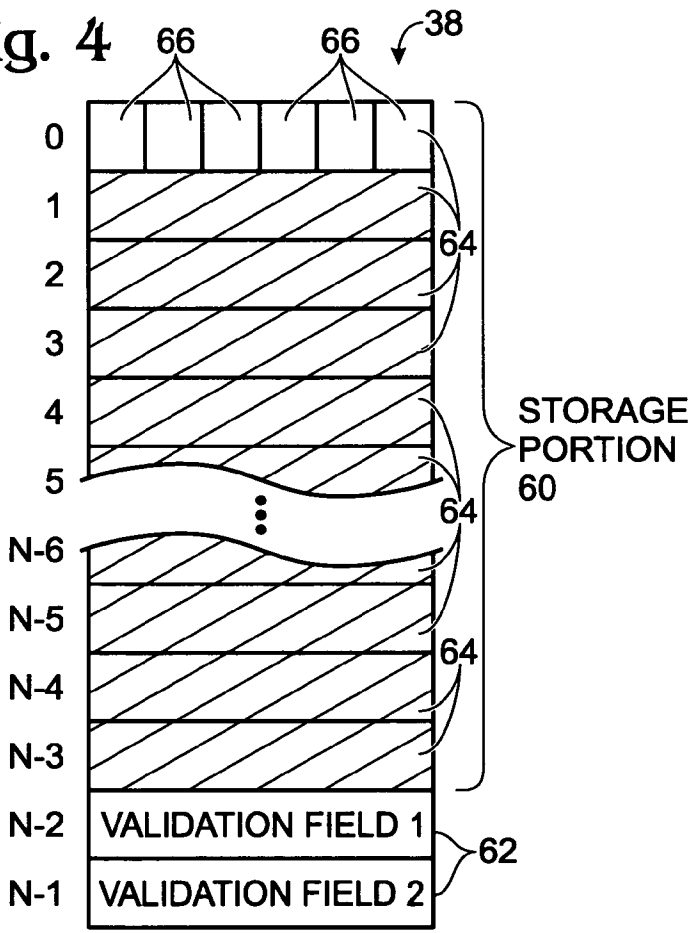
FIG. 4 depicts a representation of an example electrical storage device having a storage portion and two validation fields.

FIG. 4 is a representation of an electrical storage device 38 that may be used in conjunction with controller 26 of printing system 10 for ensuring data integrity for data transfers to the electrical storage device 38. The electrical storage device 38 may be organized as an M-bit by N memory where M represents the number of bits and N represents the size of the memory device. In some systems, electrical storage device 38 may be an 8-bit (or 1-byte) device.

Each individually addressable M-bit memory location is represented an address value ranging from 0 to N-1. Although FIG. 4 is used to illustrate some of the information that may be stored in electrical storage device 38, it will be understood that electrical storage device 38 may contain additional information not discussed. In addition, the location of the information in electrical storage device 38 may be different from those locations shown in FIG. 4. Controller 26 in printing system 10 may be required to know where at least some of the information is stored.

Memory address values 0 through N-3 define storage portion 60. This portion of memory may contain data that includes various parameters relating to the replaceable printing component 14, such as the example parameters described above.

These parameters may be organized within storage portion 60 as a plurality of parameter fields 64 associated with the corresponding replaceable printing component 14. Each parameter field 64 may contain a plurality of parameter values 66 (e.g., ink color, pages printed, or any of the other example value previously mentioned). The parameter fields 64 may be organized within storage portion 60 in blocks of parameter values 66. The blocks of parameter values 66 forming the parameter fields 64 may be configured to have a preselected size. The preselected size of these blocks may be selected to ensure that a transfer of a parameter field 64 between a print mechanism 12 and an electrical storage device 38 occurs in a single block of parameter values 66. The printing system 10 may be configured to ensure that a transfer of a single block of parameter values 66 from a print mechanism 12 to an electrical storage device 38 occurs atomically, in a single operation requiring only one write. While parameter values 66 only have been shown in the first memory address 0, it should be understood that each parameter field 64 from 0 to N-3 may be similarly organized.

Data corruption may occur when a transfer of data to storage portion 60 is interrupted. For instance, in cases where the replaceable printing component is ink container 18, it may be possible to remove the ink container while controller 26 is transferring data to electronic storage device 38. Interrupting this data transfer may compromise the integrity of the data. In such cases the replaceable printing component may need to be examined to determine whether storage portion 60 contains valid data.

To address such issues, memory address values N-2 through N-1 may be validation fields 62. The fields are used to store error detection codes which may be used to detect data corruption. These error detection codes may be any string of computer-readable characters (e.g., digits, letters, symbols) relatable to data in storage portion 60. Electrical storage device 38 and/or controller 26 may be configured to store in validation fields 62, error detection codes which are mathematically related to the data in storage portion 60. For example, an error detection code stored in a validation field 62 may be the result of a predetermined hash function performed on the data contained in storage portion 60. Another type of error detection code that may be used is a variation of parity data. Specifically, parity data mathematically related to the data in storage portion 60 may be computed and stored in validation fields 62. Other examples of suitable error detection codes include but are not limited to cyclic redundancy checks, checksums (e.g., MD5), or any other string of computer-readable characters relatable to the data in storage portion 60.

The electrical storage device 38 and/or controller 26 may be configured to store error detection codes in the validation fields 62 in a "ping-pong" (or circular in embodiments having more than two validation fields) fashion. In other words, electrical storage device 38 and/or controller 26 alternates between the validation fields 62 when storing error detection codes.

Figure 5:
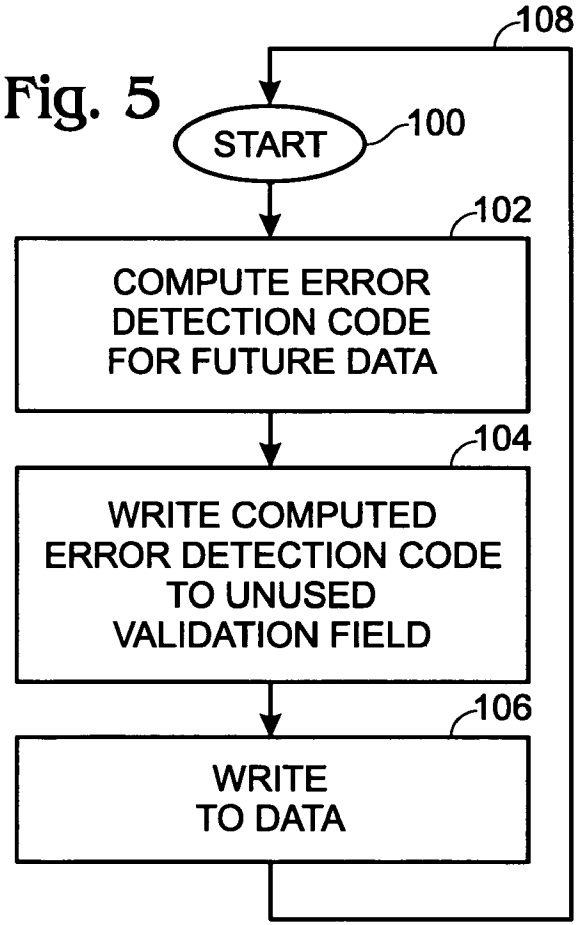
FIG. 5 depicts an example process used to update the storage portion and validation fields shown in FIG. 4.

Referring now to FIG. 5, when a first block of data is ready to be transferred to electrical storage device 38 at 100, a first error detection code, relatable to the data that will be stored in the storage portion 60 after this first data transfer, is computed at 102.

In some systems, controller 26 or another component of the printing system may maintain a cache of the data stored in storage portion 60. Using this cache, controller 26 (or another component) may update the cached data to reflect the addition of the first block of data, and then compute the error detection code for the updated cached data.

Once the first error detection code is computed, at 104, it may be written to a validation field 62. A first validation field may contain an error detection code matching the data currently in the storage portion 60; hence, the first error detection code may be stored in a second, unused validation field.

While the field which is updated at this point is referred to as the second validation field, one skilled in the art will understand that this is an arbitrary classification. Any validation field may be updated with an error detection code at any time, so long as the validation field to be updated does not contain an error detection code relatable to the data currently stored in storage portion 60. An exception to this rule occurs in cases where more than one validation field 62 contains an error detection code relatable to the data currently in storage portion 60. In such instances, the first error detection code may be written to any validation field 62.

Once the first error detection code is written at 104, the first block of data may be transferred and stored in the storage portion 60 at 106.

This process may be repeated for additional transfers of data. Continuing the above example, prior to, a second transfer of data to the electrical storage device 38 (returning back to 100 along arrow 108), a second error detection code may be computed at 102 that is relatable to the data that will be stored in the storage portion 60 after the second transfer. This second error detection code may be written to the first validation field at 104 (as described above, the second validation field now contains the first error detection code relatable to the data currently in the storage portion). Once the second error detection code is written to the first validation field, the second transfer of data may be completed at 106.

Figure 6:
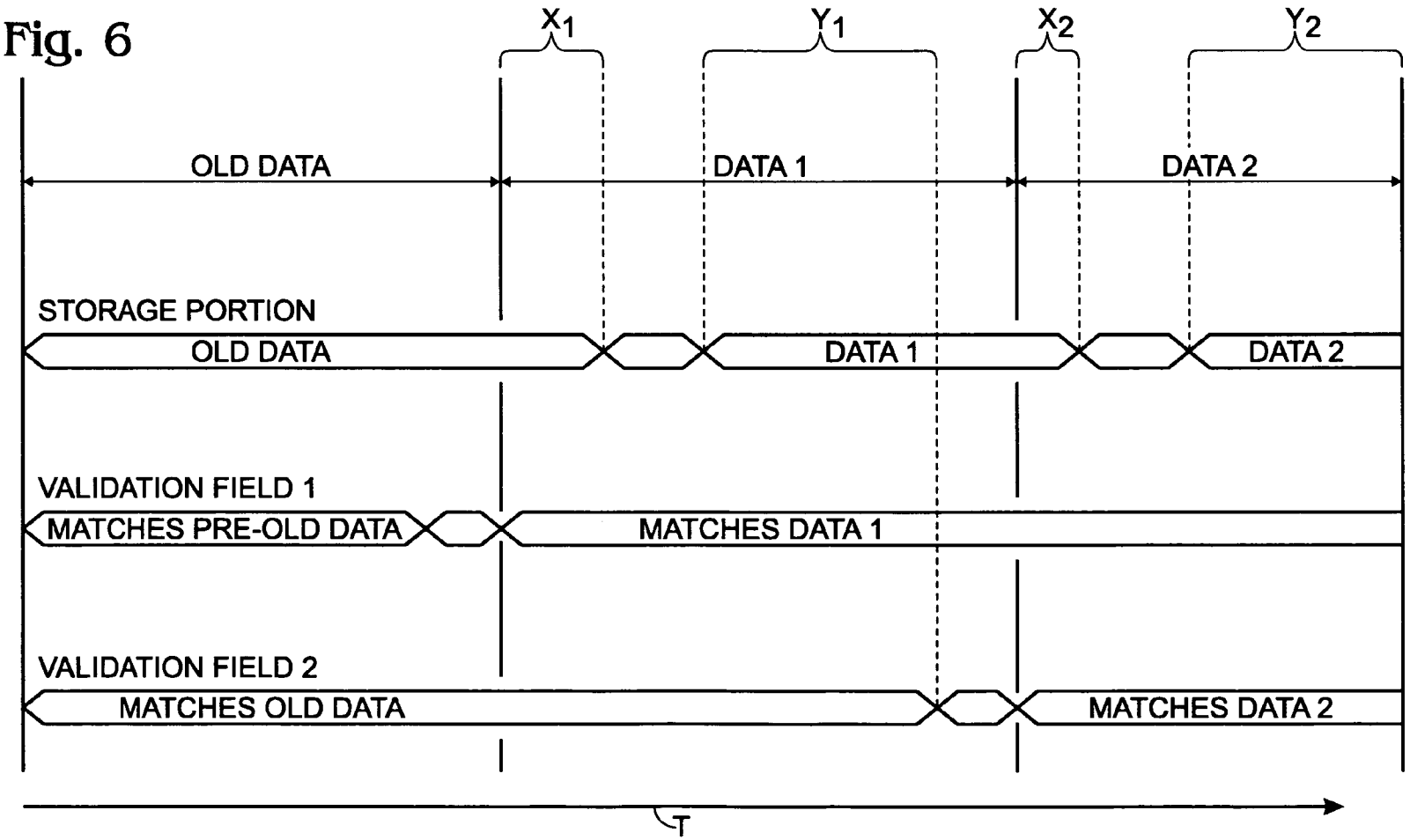
FIG. 6 is a timing diagram illustrating an example data transaction between a print mechanism and a replaceable printing component.

In FIG. 6, which depicts the states of a storage portion 60 and two validation fields 62 during two example updates, time passes towards the right, as indicated by arrow T. The storage portion starts out containing OLD DATA, and validation field 2 contains an error detection code relatable to the OLD DATA. The contents of field 1 at this point are not relevant. However, before storage portion 60 is updated so that it contains DATA 1, validation field 1 is updated so that it contains an error detection code relatable to DATA 1. Thus, for the time period denoted by $X_1$, validation field 1 contains an error detection code relatable to data that will be stored in storage portion 60 in the future, and validation field 2 contains an error detection code relatable to data currently contained in storage portion 60.

Once validation field 1 is updated, storage portion 60 may be updated to contain DATA 1. Thus, for the time period marked by $Y_1$, validation field 1 contains an error detection code relatable to the data currently stored in storage portion 60, and validation field 2 contains an error detection code relatable to the data stored in the storage portion 60 immediately prior.

Continuing with FIG. 6, before storing DATA 2 in storage portion 60, validation field 2 may be updated to contain an error detection code relatable to DATA 2. Once validation field 2 is updated, storage portion 60 may be updated to contain DATA 2.

As seen in FIG. 6 and from the previous discussion, immediately prior to transferring data to the storage portion 60, at points in time marked $X_1$ and $X_2$, one validation field 62 may contain an error detection code relatable to the data currently in storage portion 60. Another validation field 62 may contain an error detection code relatable to the data that will be stored in storage portion 60 after the transfer.

At other points in time, marked as $Y_1$ and $Y_2$ in FIG. 6 one validation field may contain an error detection code relatable to the data currently in storage portion 60, and the other validation field may contain an error detection code relatable to the data that was stored in storage portion 60 immediately prior to the current data.

Figure 7:
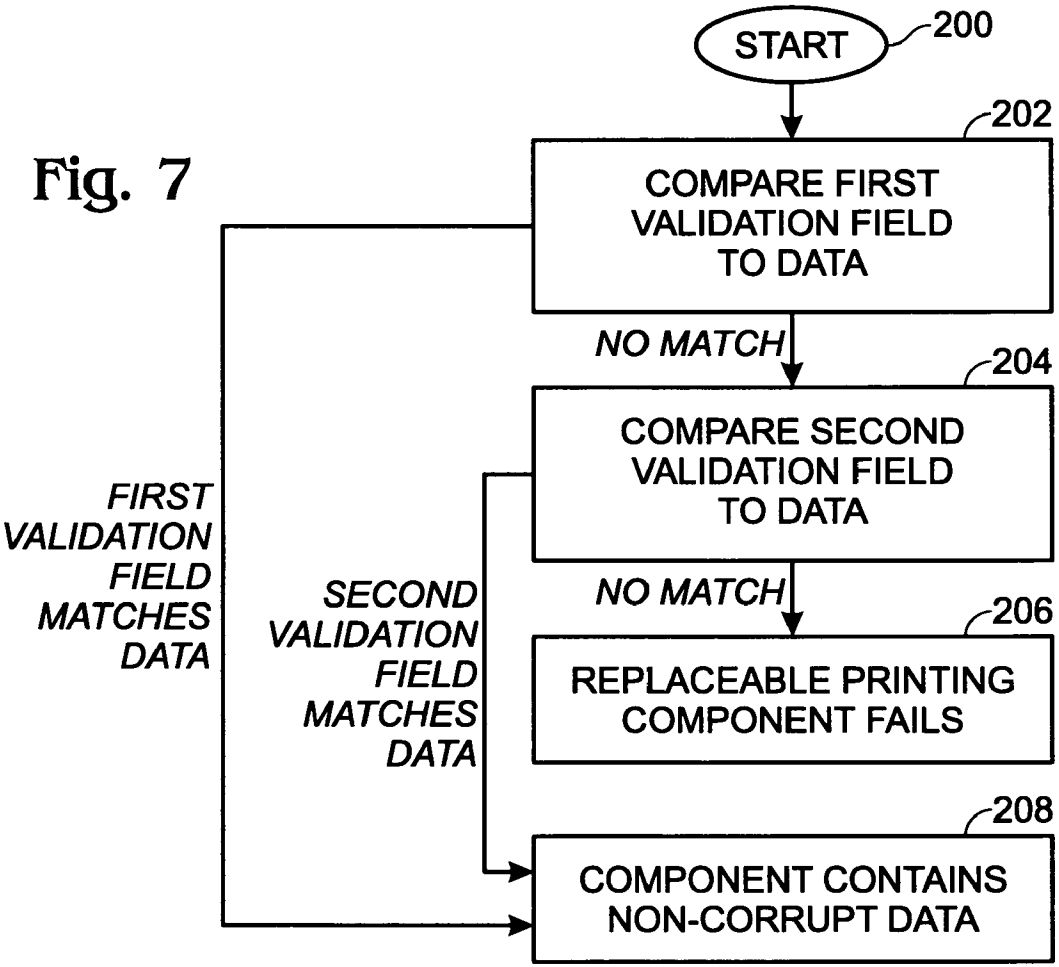
FIG. 7 depicts an example process used to check the validity of the storage portion shown in FIG. 4.

Another aspect of the present disclosure involves error detection. As seen in FIG. 7, the integrity of the data may be verified by relating the contents of the validation fields 62 one-at-a-time to the data in the storage portion 60. If the error detection code contained in any validation field 62 matches the data in the storage portion 60, the data is valid and the replaceable printing component is not rejected. If no validation field 62 contains an error detection code matching the data, however, the data in the storage portion 60 is corrupt and the replaceable printing component may be rejected.

Starting at 200 in FIG. 7, the content of a first validation field is compared to the data contained in the storage portion at 202. This comparison corresponds to the type error detection code used. For instance, if the error detection codes are hash sums, the comparison involves computing the hash sum of the data in storage portion 60 using the same hash function that was used earlier to populate validation fields 62.

If the content of the first validation field 62 is relatable to the data in the storage portion, the data in storage portion 60 is not corrupt and the replaceable printing component is accepted by the printing system 10 at 208. If the content of the first validation field 62 is not relatable to the data in storage portion 60, the process proceeds to 204, where the content of a second validation field 62 is compared to the data in storage portion 60. If there is a match, the process goes to 208 and the replaceable printing component is accepted. If there is no match, however, the data in the storage portion 60 is corrupt, and printing system 10 may reject the replaceable printing component at 206.

One skilled in the art will understand that while the process depicted in FIG. 7 compares the contents of two validation fields to the data in the storage portion 60 (in 204 and 206), the content of additional validation fields may be compared to the data in storage portion 60. Such additional comparisons may occur depending on how many validation fields are configured into a particular electrical storage device 38.

It is believed that the disclosure set forth above encompasses multiple distinct embodiments of the invention. While each of these embodiments has been disclosed in specific form, the specific embodiments thereof as disclosed and illustrated herein are not to be considered in a limiting sense as numerous variations are possible. The subject matter of this disclosure thus includes all novel and non-obvious combinations and subcombinations of the various elements, features, functions and/or properties disclosed herein. Similarly, where the claims recite "a" or "a first" element or the equivalent thereof, such claims should be understood to include incorporation of one or more such elements, neither requiring nor excluding two or more such elements.

What is claimed is:

1. A printing system for selectively depositing visible material on print media, the printing system comprising:

a print mechanism configured to receive a replaceable printing component, the print mechanism including a control portion for transferring data between the print mechanism and the replaceable printing component; and a replaceable printing component including an electrical storage device responsive to printing system control signals for selectively storing information received from the print mechanism, the electrical storage device including:

a storage portion containing data associated with the replaceable printing component; and first and second validation fields configured to store error detection codes relatable to the data contained in the storage portion to determine whether the data is valid;

wherein the electrical storage device is configured, prior to a first transfer of data from the print mechanism to the storage portion, to receive and store in one of the first and second validation fields a first error detection code related to the data currently contained in the storage portion, and the electrical storage device is configured to receive and store in the other of the first and second validation fields a second error detection code related to the data that will be contained in the storage portion after the first data transfer; and wherein the control portion is configured to transfer, to the first validation field, the second error detection code related to the data that will be contained in the storage portion after the first data transfer and to transfer, to the second validation field, a third error detection code related to the data that will be contained in the storage portion after a second data transfer successively following the first data transfer.

2. The printing system for selectively depositing visible material on print media of claim 1, wherein prior to a subsequent transfer of data from the print mechanism to the storage portion, the electrical storage device is configured to receive and store, in the one of the first and second validation fields not containing data related to the data contained in the storage portion immediately prior to the subsequent transfer of data, an error detection code related to the data that will be contained in the storage portion after the subsequent transfer.

3. The printing system for selectively depositing visible material on print media of claim 2 wherein the storage portion comprises a plurality of parameter fields associated with the replaceable printing component, and each parameter field of the plurality of parameter fields comprises a plurality of parameter values, the plurality of parameter fields sized in the storage portion in blocks of the parameter values having a preselected size such that a transfer of a single block to one of the parameter fields may be made atomically in a single write operation.

4. The printing system for selectively depositing visible material on print media of claim 1, wherein the control portion is configured to compute parity data, comprising the second error detection code, from the data that will be contained in the storage portion after the first transfer.

5. The printing system for selectively depositing visible material on print media of claim 1, wherein the control portion is configured to compute a cyclic redundancy check, comprising the second error detection code, from the data that will be contained in the storage portion after the first transfer.

6. The printing system for selectively depositing visible material on print media of claim 1, wherein the control portion is configured to compute a hash sum, comprising the second error detection code, from the data that will be contained in the storage portion after the first transfer.

7. The printing system for selectively depositing visible material on print media of claim 1 wherein the print mechanism is an ink-jet printing system, the visible material is ink, and the replaceable printing component further includes a replaceable ink container containing a quantity of ink, the replaceable ink container providing ink to the print mechanism.

* * * * *